US010837458B1

(12) United States Patent
Proctor

(10) Patent No.: US 10,837,458 B1
(45) Date of Patent: Nov. 17, 2020

(54) BREAK-AWAY/EASY CLEAN NON DETACHABLE FAN

(71) Applicant: Leona Teresa Proctor, Midwest City, OK (US)

(72) Inventor: Leona Teresa Proctor, Midwest City, OK (US)

( * ) Notice: Subject to any disclaimer, the term of this patent is extended or adjusted under 35 U.S.C. 154(b) by 0 days.

(21) Appl. No.: 16/350,155

(22) Filed: Oct. 9, 2018

(51) Int. Cl.
*F04D 29/34* (2006.01)
*F04D 19/00* (2006.01)
*F04D 29/32* (2006.01)

(52) U.S. Cl.
CPC ..... *F04D 29/34* (2013.01); *F04D 19/002* (2013.01); *F04D 29/329* (2013.01); *F05B 2260/30* (2013.01)

(58) Field of Classification Search
CPC ..... F04D 19/002; F04D 29/34; F04D 29/329; F04D 29/364; F05B 2260/30
USPC ..... 416/142, 143, 204 R, 205
See application file for complete search history.

(56) References Cited

U.S. PATENT DOCUMENTS 116,419 A * 1/1871 Drane et al. ..... 416/87
186,243 A * 1/1877 Fowler ..... 416/142
213,644 A * 3/1879 Feldman et al. ..... 416/79
316,655 A * 4/1885 Pittman ..... 185/13
377,573 A * 2/1888 Murray ..... 416/40
1,361,785 A * 12/1920 Tucker ..... F04D 29/382 416/142
2,245,015 A * 6/1941 Sibal ..... F21L 2/00 416/5
2,990,149 A * 6/1961 Samms ..... F42B 15/36 244/138 A
3,401,874 A * 9/1968 Covington ..... A45B 3/00 416/142
3,559,962 A * 2/1971 Enssle ..... B01F 7/00066 366/308
4,776,761 A * 10/1988 Diaz ..... F04D 29/366 416/142
6,213,716 B1 * 4/2001 Bucher ..... F04D 25/088 416/142
2004/0151588 A1 * 8/2004 Liang ..... F04D 25/088 416/142
2005/0109291 A1 * 5/2005 Karanik ..... F01P 5/02 123/41.63
2009/0016883 A1 * 1/2009 Bendiba ..... F04D 25/088 416/142

* cited by examiner

*Primary Examiner* — William V Gilbert
(74) *Attorney, Agent, or Firm* — Leona Proctor; Prose

(57) ABSTRACT

This invention is a specially designed fans that would feature adjustable blades that would Provide a way of easy cleaning and maintenance it is for all types of fans ceiling fans, box Fans, industrial fans, outdoor AC unit fans, oscillating fans, and individual hospital room fans. Hinged blades can be angled down for easy cleaning and maintenance this is a new improved Fans made up of five assemblies which is a set of blades, a hub, a set of latches, a set of Hinges, a set of latch studs. Fans get so filthy and have been difficult to clean for a century. Now the negative impact filth and dirt have on people with allergies, asthma, colds, emphysema And respiratory problems has been solved with the Break-Away/Easy Clean Non-Detachable Fans forever, history has changed for the new innovative industry of the Break-Away/Easy Clean Non-Detachable Fans.

1 Claim, 2 Drawing Sheets

Figure 8:
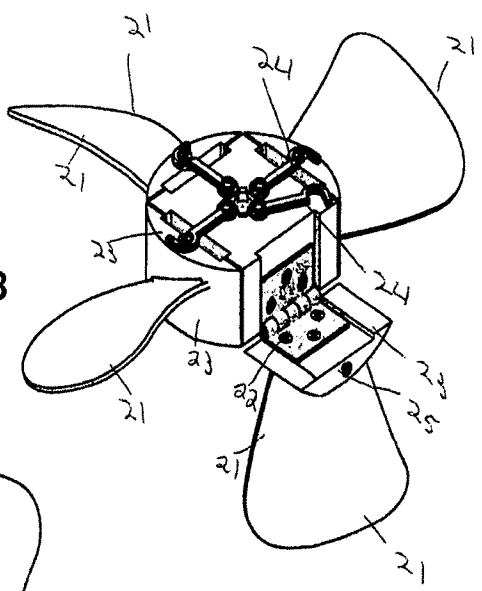

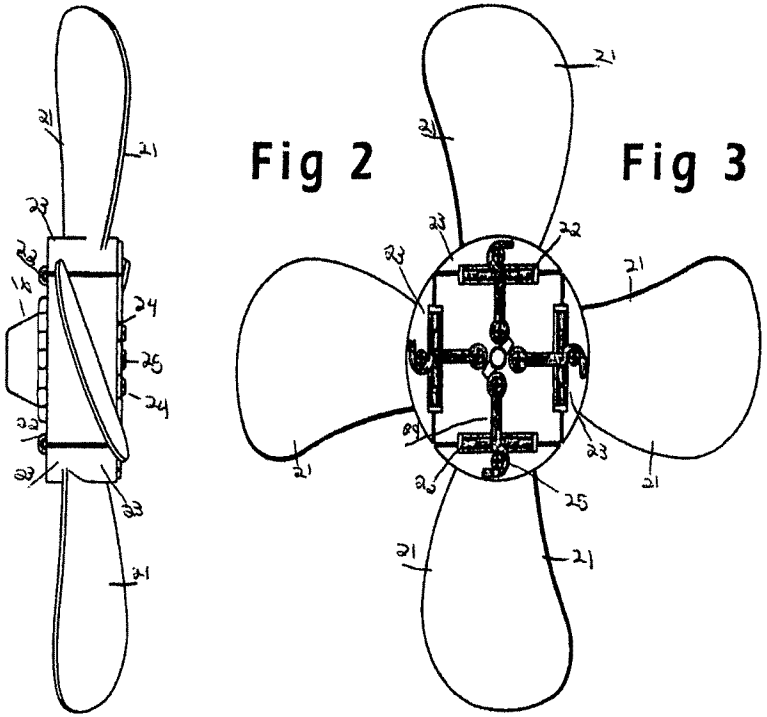
Fig 2
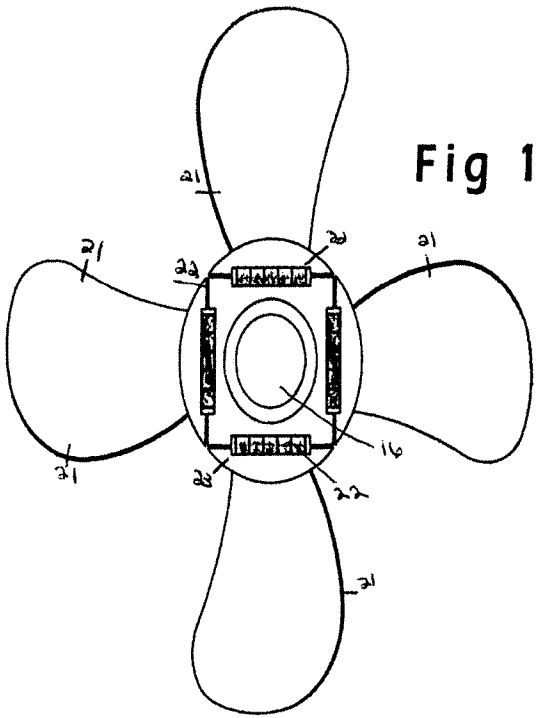
Fig 3
Fig 1
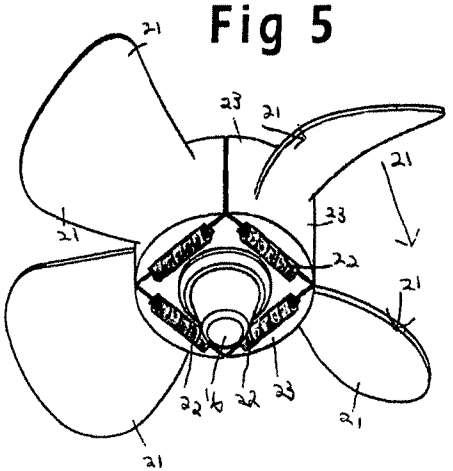
Fig 5
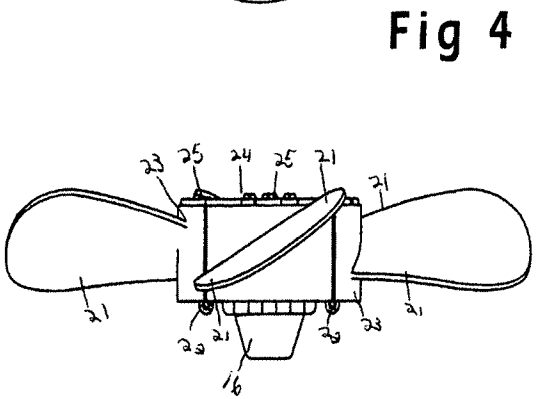
Fig 4

BREAK-AWAY/EASY CLEAN NON DETACHABLE FAN

RELATED U.S. APPLICATION DATA

I have a provisional claim No. 61/204,089

BACKGROUND OF THE INVENTION

Numerous fans have been provided in prior art that is questionable for instance the Break-Away/Easy Clean Non-Detachable Fans both domestic and commercial use for Example is far better and more innovative than prior arts U.S. Pat. No. 116,419 to Drane Et al: U.S. Pat. No. 186,243 to Fowler: U.S. Pat. No. 213,644 to Feldman: U.S. Pat. No. 316,655 to Pittman: U.S. Pat. No. 377,573 to Murray: U.S. Pat. No. 1,361,785 To Tucker: U.S. Pat. No. 2,245,015 to Sibal: U.S. Pat. No. 2,990,149 to Samms: U.S. Pat. No. 3,401,874 to Covington: U.S. Pat. No. 345,540 to Marcmann: U.S. Pat. No. 3,559,962 Enssle Et al, And foreign patent NOS. 136635 Knoche of Australia: 658,619 to Heller of France: 413,672 to Gazzolo of Italy: 500,367 & 740,975 both of Russia: 34,929 to Hultman of Sweden all are illustrative of such prior art. While all these Units are suitable for their particular purposes by which they address they are by no means A Break-Away/Easy Clean Non-Detachable Fans by which a set of latches and a set of Latch studs holds the blades to the hinged hub and when unlatched the latch blades unfolds Downward to a (90) degree angle for cleaning and maintenance purposes which is Suitable for the present times and hereafter in the future for a century yes 100-years Or more as described the five assemblies with a motor is the best invention of all times.

SUMMARY OF THE INVENTION

The primary objective of the present invention is basically a set of blades a hub, a set of hinges, a set of latches, and a set of latch studs, to upgrade the prior art device to overcome the outdated art in the present market today. Another objective is to provide five fans with these five assemblies that when you unlatch the latch from the latch studs from the hinged hub the blades unfold downward to a (90) degree angle for cleaning and maintenance purposes on the present inventions of these art devices. Also additionally an oscillating fan, box fan, ceiling fan, industrial fan, and outdoors AC unit fans help overcome the shortcomings of all the prior art devices on the present market today. Once the blades are latched And secured to the hinged hub this is a "means" for propelling air and moving air around in a Most modern innovative way to propel clean air on the present market today. And for all times To come what an outstanding invention. These five fans with these five assemblies will be economical in cost to manufacture and produce on the present market today. These accomplishments of the related devices of these inventions may be embodied in these forms illustrated is accompanied by drawing.

BRIEF DESCRIPTION OF THE DRAWING FIGURES

FIG. 1. Is a top view of the invention with the blades latched to the latch studs secured for rotation or propelling air.

FIG. 2. Is a side view of the invention.

FIG. 3. Is a bottom view of the invention showing the latches secured to the latch studs.

FIG. 4. Is a side view showing the hinged blades and the hub.

FIG. 5. Is a isometric view of the invention while spinning showing full assembly of the invention.

Figure 6:
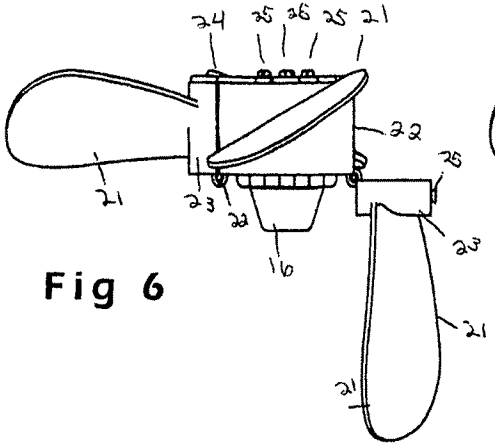

FIG. 6. Is a side view of the invention with one of the blades unlatched from the latch stud.

Figure 7:
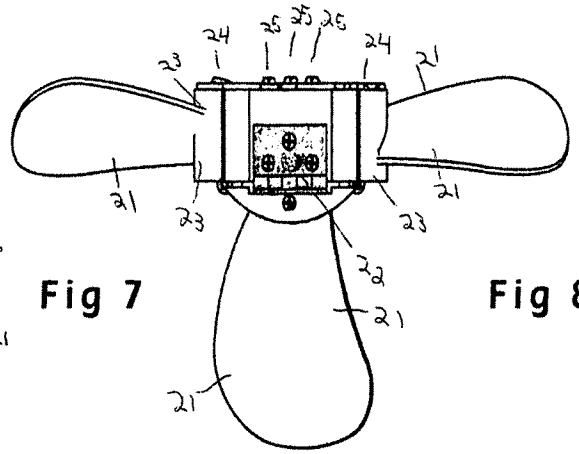

FIG. 7. Is a side view of the invention showing the hinge and latch stud and the blade at a (90) Degree angle.

FIG. 8. Is a bottom view of the invention showing the latches with one of the latches at rest from The latch studs showing the hinge and blade.

Figure 9:
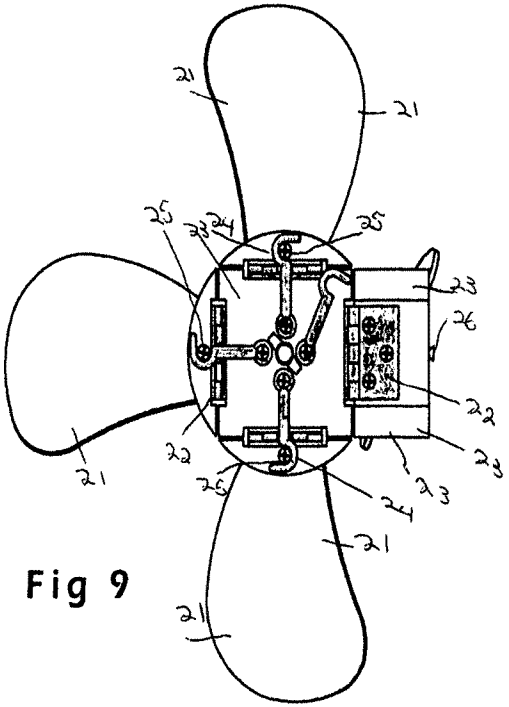

FIG. 9. Is another bottom view of the invention showing three latched secured blades and One latch at rest showing the hinge and latch stud.

Figure 10:
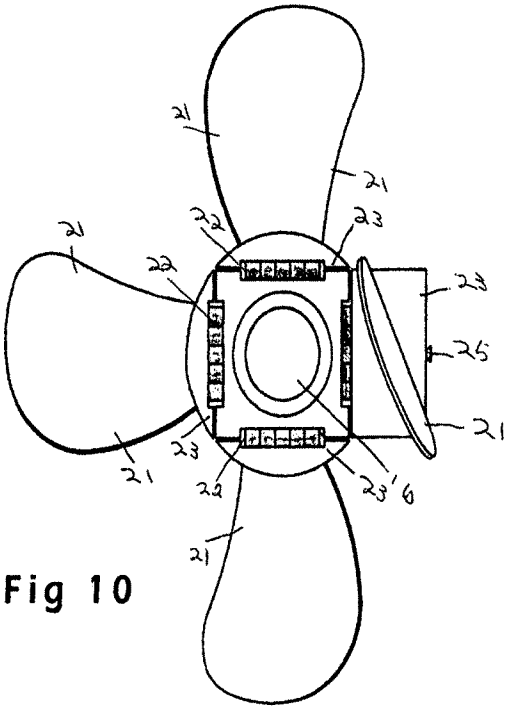

FIG. 10. Is a top view of the invention showing the hub and one blade at rest.

DETAILED DESCRIPTION OF THE PREFERRED INVENTION

FIG. 1. Is a top view of the invention 16, showing a cap on the hub, 22, showing a hinge, 21, showing a blade, 23, showing a hub, 21, showing a blade, 21, still showing a blade, 23, showing a hub, 21 showing a blade, 22, showing a hinge, 21, showing a blade.

FIG. 2. Is a side view of the invention with 16 on the front of the invention showing a cap, 22, showing a hinge, 23, showing a hub, 21, showing a blade, and on the backside Of FIG. 2. 21, showing a blade, 24, showing a latch, 25, showing a latch stud, 24 showing a Latch again, 23, showing the hub, 21 showing a bottom blade.

FIG. 3, Is a bottom view of the invention with, 21, showing a blade, 22, showing a hinge, 24, Showing a latch, 21, showing a blade, 23, showing a hub, 23, showing a hub, 21, showing a blade, 21, showing a blade, 22, showing a hinge, 21, showing a blade, 21, showing a blade, 23, showing a hub, 25, showing a latch stud, 21, showing a blade.

FIG. 4. Is another side view of the invention with the top side 23, showing the hub, 25, Showing the latch stud, 24, showing the latch, 25, showing the latch stud, 21, showing the blade, 21, showing another blade, 21, showing bottom of same blade, 23, showing hub, 22, showing hinge, 16, showing bottom cap, 21, show blade side view, 22), showing hinge, 21, showing left blade.

FIG. 5. Is a isometric view of the invention while spinning 21, left side blade, 21, showing Left side blade, 21, high left side blade, (23, showing a hub, 21, right side blade, 21, showing inside of right side blade 23, showing right side of hub 22, showing hinge, 21, Showing lower right side of blade, 21, showing lower right blade, 23, showing hub, 22, showing hinge, 16, bottom cap, 22, showing hinge in different position.

FIG. 6. Is also a side view of the invention with one of the blades unlatched from the latch stud and at rest, 22, showing the hinge area, 25, showing the stud, 23, showing part of the hub at rest, 21, showing one of the blades at rest, 21, showing the inside of blade at rest. 16, Showing the bottom cap, 22, showing left bottom hinge, 23, showing left secured hub, 21, showing left side secured blade, 24, showing latch on top of side view, 25, showing top Of side view stud, 25 also showing a top side view of stud, 25, showing another top side Of the stud, 21 showing the side view blade.

FIG. 7. is a side view showing the side hinge, 22, showing the side hinge with the blade at rest, 21, showing lowered side blade at rest, 21, showing the lowered side blade still at rest, 23, Showing the left side of the secured hub, 21, showing the left side of the secured blade, 23, Showing left side of secured top of hub, 24, showing the top of the side view latch, 25, showing top of side view stud, 25, also showing the top of side view stud, 25, another top of IC side view stud, 24, showing right side of side view latch, 21, showing right side of secured blade, 21, showing inside of right side of same blade, 23, showing secured right side of hub, FIG. 8. is a bottom view of the invention showing the latches with one of the latches at rest from the latch studs showing the hinge and blade, 24, showing the latch at rest, 23, showing the hub at rest, 25, showing a latch stud at rest, 21, showing a blade at rest, 21, still showing a blade at rest, 22, showing a side view of a hinge while a blade is at rest, 23, showing a secured hub, 21, showing a secured blade, 23, still showing a secured hub, 21, showing a blade on the opposite side secured, 21, still showing the same blade secured, 24, showing the latch secured, 21, showing the blade secured.

FIG. 9. Is another bottom of the invention showing three latches secured, 21, showing a secured blade, 25, showing a secured latch stud, 22, showing a secured hinge, 21, showing a secured blade, 25, showing a secured latch stud on the other side, 23, showing a View bottom hub, 24, showing a secured bottom latch, 21, showing a secured blade, 21, still showing a secured bottom blade, 25, showing a secured latch stud, 23, showing bottom hub at rest, 25, showing latch stud at rest, 22, showing a hinge at rest bottom view, 23, showing IC bottom view of hub at rest, 23, still showing bottom view of hub at rest, 24, showing latch secured bottom view, 21, showing bottom view of secured blade.

FIG. 10. is another top view showing the right side blade at rest, 23, showing the hub at rest, 25, showing the latch stud at rest, 21, showing the blade at rest, 16, showing the cap on top of hub, 23, showing the hub secured, 21, showing the blade secured, 22, showing the hinge secured, 23, showing another position of the hub secured, 21, showing the blade secured, 21, showing the other side of the blade secured, 22, showing the hinge on top secured, 21, showing a different blade secured on top, 21, top blade still secured, 23, Showing top hub secured.

What is claimed is:

1. A fan with folding blades, comprising:

a hub having a first side and a second side opposite said first side, said hub having a first side face, a second side face, a third side face and a fourth said face, each of said side faces extending from said first side to said second side and spaced about a perimeter of said hub, each of said side faces having a groove extending from said first side to said second side;

a first blade, a second blade, a third blade and a fourth blade, each said blade further comprising a first end portion having a first side, a second side opposite said first side of said respective blade and an end face, each of said respective end faces of said respective blades correspond to and are configured to abut a respective one of said side faces of said hub, each of said end faces of said blades includes a groove extending from said first side of said respective blades to said second side of said respective blades;

each of said blades being connected to said hub by a hinge, each of said hinges having a first portion received in a respective one of said grooves of said side faces of said hub and a second portion received in a respective one of said grooves of said end faces of said blades;

each of said blades having a latch stud on said second side;

said hub having a number of latches corresponding to said latch studs, each of said latches having a first end connected to said second face of said hub and a second end being in the shape of a hook receiving a respective one of said latch studs;

whereby said latches are configured to detach from respective ones of said latch studs permitting said blades to pivot about said respective hinges.

* * * * *